US012090383B2

(12) United States Patent
Valery

(10) Patent No.: US 12,090,383 B2
(45) Date of Patent: Sep. 17, 2024

(54) GOLF SWING TRAINING DEVICE

(71) Applicant: Weventz Valery, Middletown, CT (US)

(72) Inventor: Weventz Valery, Middletown, CT (US)

( * ) Notice: Subject to any disclaimer, the term of this patent is extended or adjusted under 35 U.S.C. 154(b) by 240 days.

(21) Appl. No.: 17/827,738

(22) Filed: May 29, 2022

(65) Prior Publication Data

US 2023/0381622 A1 Nov. 30, 2023

(51) Int. Cl.
*A63B 69/36* (2006.01)
*A63B 37/00* (2006.01)

(52) U.S. Cl.
CPC ..... *A63B 69/3655* (2013.01); *A63B 37/0006* (2013.01); *A63B 37/0024* (2013.01); *A63B 37/008* (2013.01)

(58) Field of Classification Search
CPC ..... A63B 69/3655; A63B 37/0006; A63B 37/0024; A63B 37/008; A63B 43/00; A63B 2043/001; A63B 57/10; A63B 2071/0694; A63B 2209/00
USPC ..... 473/139–149, 257, 258, 261–266, 278, 473/279, 409, 423, 429
See application file for complete search history.

(56) References Cited

U.S. PATENT DOCUMENTS 1,753,654 A * 4/1930 Hanson ..... A63B 69/0091 473/139
3,348,847 A * 10/1967 Fischl ..... A63B 69/3661 428/17
3,708,175 A * 1/1973 Barney ..... A63B 69/3655 473/139
4,143,877 A 3/1979 Jeffries
5,451,059 A * 9/1995 Weis ..... A63B 69/3655 473/149
6,159,106 A * 12/2000 Adams ..... A63B 69/36211 473/260
6,554,716 B1 * 4/2003 Loh ..... A63B 69/3623 473/148
6,569,026 B1 * 5/2003 Weis ..... A63B 69/3661 473/278
7,347,790 B2 3/2008 Zimmerman
7,549,932 B1 * 6/2009 Miyamoto ..... A63B 69/3661 473/278
8,118,685 B2 2/2012 Monge
8,157,667 B2 * 4/2012 Tome ..... A63B 69/3623 473/150
8,251,841 B2 * 8/2012 Ishii ..... A63B 63/003 473/409

(Continued)

FOREIGN PATENT DOCUMENTS

GB 2423031 8/2006

*Primary Examiner* — Nini F Legesse

(57) ABSTRACT

A golf swing training device for training a user to aim a golf swing in the desired direction includes a resiliently deformable body having a top surface, a bottom surface, and a perimeter surface extending between the top surface and the bottom surface. The bottom surface is configured to support the body on a support surface, and the body is elongated along a horizontal central longitudinal axis from a first end to a second end. The body is symmetrical about a vertical central plane. There is a divot penetrating the top surface adjacent the first end coupled to a compactable, resiliently deformable ball. The body is constructed of a low-density material and is configured to abruptly decelerate when moving through a quantity of air due to an air resistance force.

16 Claims, 6 Drawing Sheets

(56) References Cited

U.S. PATENT DOCUMENTS

| | | | | |
|---|---|---|---|---|
| 8,323,120 | B2 | 12/2012 | Lorenzana | |
| D869,806 | S | 12/2019 | Catania | |
| 2006/0217212 | A1* | 9/2006 | Sindelar | A63B 69/3676 473/278 |
| 2007/0270233 | A1 | 11/2007 | Ruston | |
| 2008/0099994 | A1 | 5/2008 | Tuttle | |
| 2008/0287218 | A1* | 11/2008 | Freund | A63B 69/00 473/377 |
| 2013/0260921 | A1 | 10/2013 | Brooks | |
| 2013/0316841 | A1* | 11/2013 | Coleman | A63B 69/3617 473/280 |

* cited by examiner

GOLF SWING TRAINING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to training devices and more particularly pertains to a new training device for training a user to aim a golf swing in the desired direction.

(2) Description of Related Art Including Information Disclosed Under 37 CFR 1.97 and 1.98

The prior art relates to training devices for aiming golf swings. In some cases, these devices resort to means of securing a struck ball to a ground or floor surface or some other stationary member. These devices often alter the path of a struck ball, making it difficult for the user to properly assess how successful the user's golf swing was. Additionally, the securing mechanisms can fail, leading to damage or injury. Some devices also are limited in where they can be used, for example, by filling a large space, by having elements meant to penetrate a ground surface, or by being used in conjunction with a standard golf ball meant to be struck at force and to travel significant distances. Further, some devices purport to be for indoor use due to being constructed of lighter or softer materials, but these devices can be easily lost and can cause damage or injury despite being constructed differently from a standard golf ball. Or in some devices that use light or soft materials, the device is a substantially different geometry from a standard golf ball, resulting in a training scenario that does not accurately simulate striking a golf ball with a club.

The prior art does not relate to a golf swing training device that relies on a member alike in size, shape, and position on a golf tee to a golf ball which is free to travel through the air indoors without being secured to a stationary member and without posing a risk of loss, damage, or injury due to the reasons mentioned above. A device with this ball member as described and the means to decelerate quickly due to an air resistance force resolves the limitations present in the prior art.

BRIEF SUMMARY OF THE INVENTION

An embodiment of the disclosure meets the needs presented above by generally comprising a resiliently deformable body having a top surface, a bottom surface, and a perimeter surface extending between the top surface and the bottom surface. The bottom surface is configured to support the body on a support surface, and the body is elongated along a horizontal central longitudinal axis from a first end to a second end. The body is symmetrical about a vertical central plane. There is a divot penetrating the top surface adjacent the first end coupled to a compactable, resiliently deformable ball. The body is constructed of a low-density material and is configured to abruptly decelerate when moving through a quantity of air due to an air resistance force.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
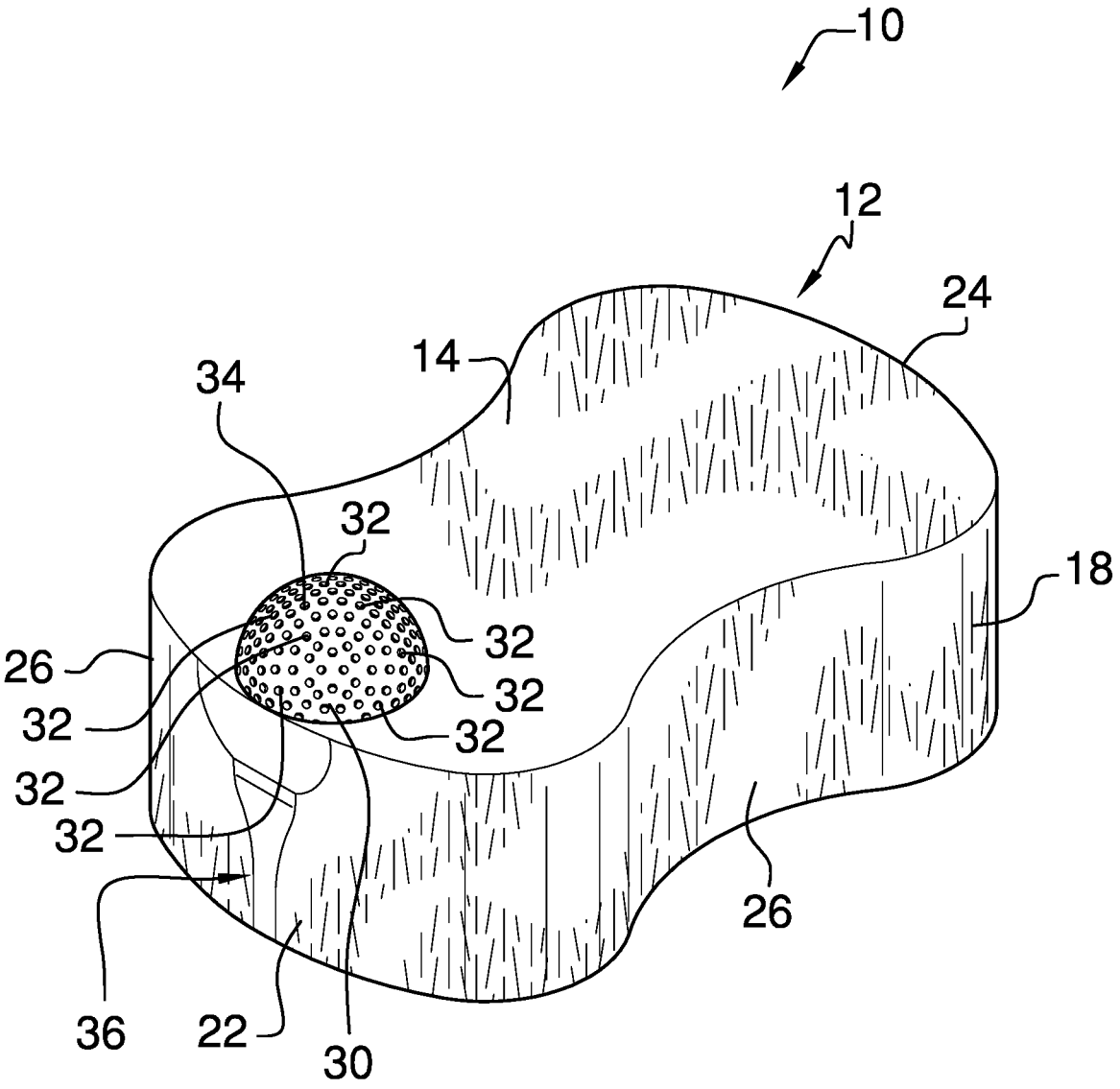
FIG. 1 is a top front side perspective view of a golf swing training device according to an embodiment of the disclosure.
Figure 2:
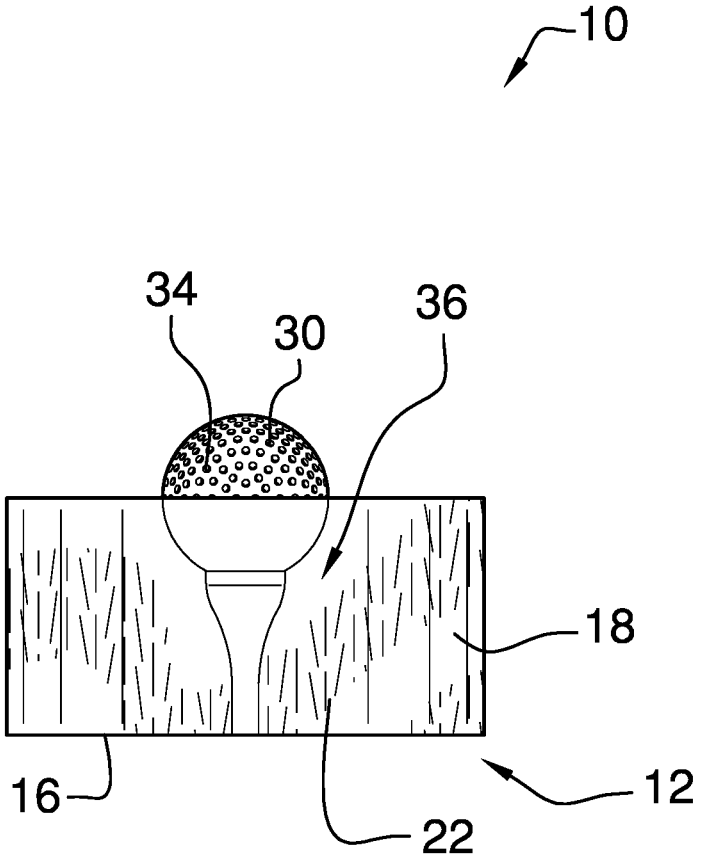
FIG. 2 is a front view of an embodiment of the disclosure.
Figure 3:
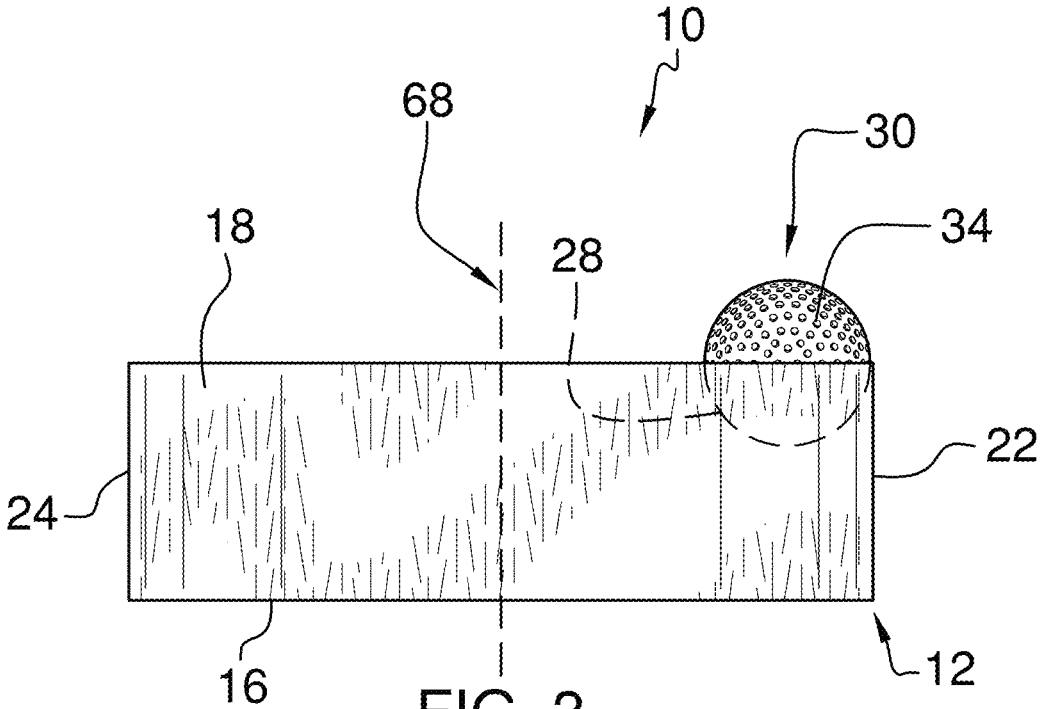
FIG. 3 is a side view of an embodiment of the disclosure.
Figure 4:
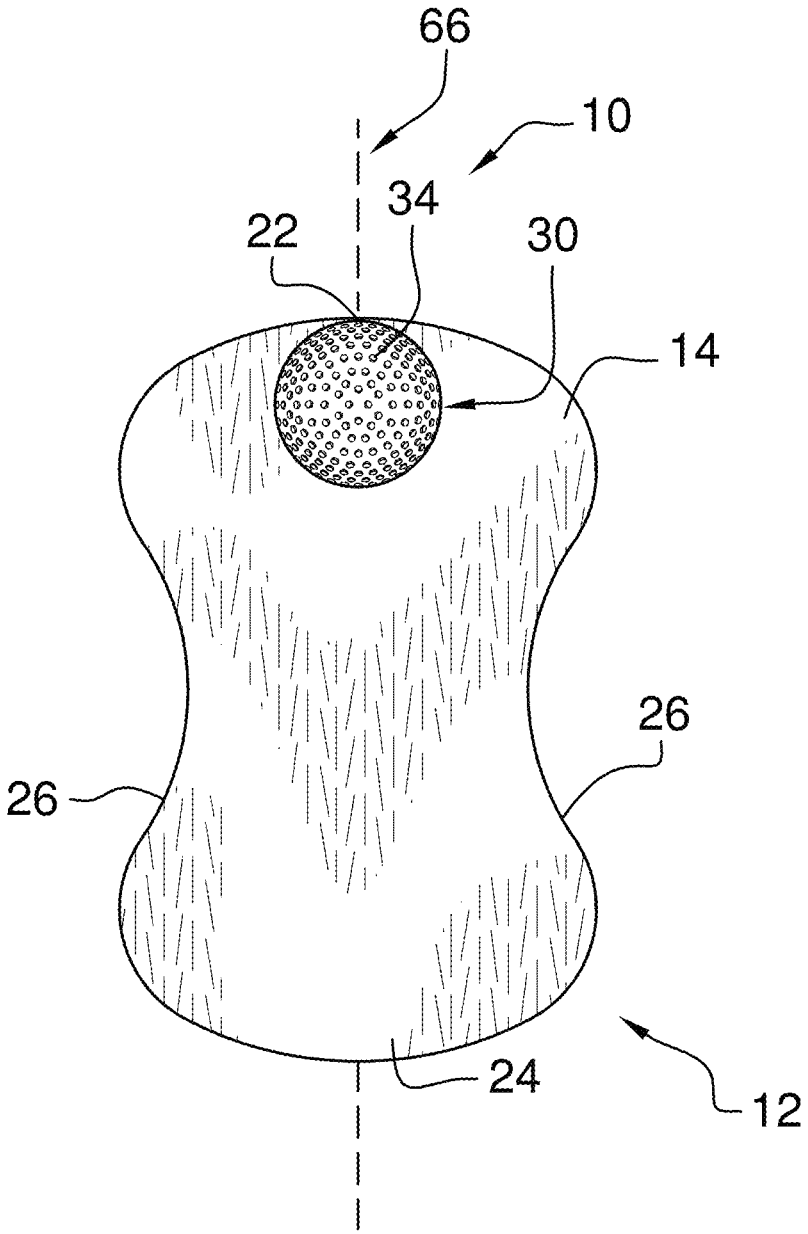
FIG. 4 is a top view of an embodiment of the disclosure.
Figure 5:
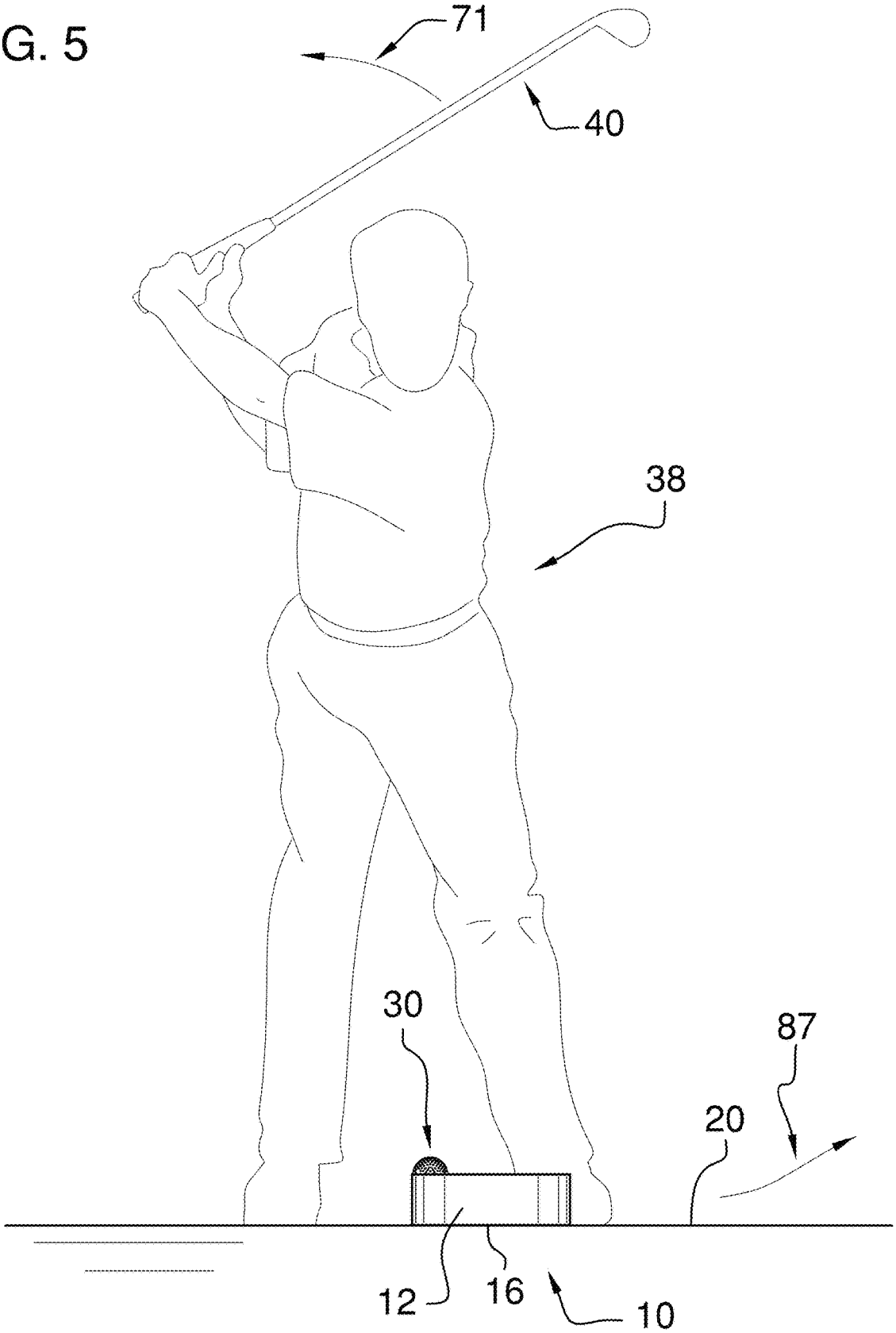
FIG. 5 is an in-use view of an embodiment of the disclosure.
Figure 6:
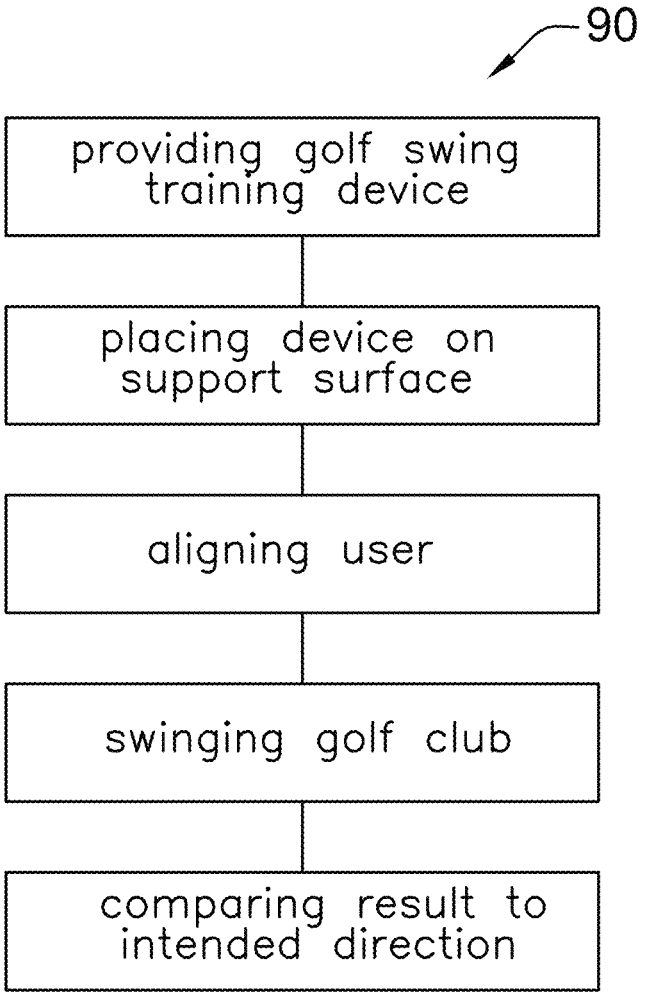
FIG. 6 is a schematic view of a method according to the disclosure.

With reference now to the drawings, and in particular to FIGS. 1 through 6 thereof, a new training device embodying the principles and concepts of an embodiment of the disclosure and generally designated by the reference numeral 10 will be described.

As best illustrated in FIGS. 1 through 6, the golf swing training device 10 generally comprises a resiliently deformable body 12 having a top surface 14, a bottom surface 16, and a perimeter surface 18 extending between the top surface 14 and the bottom surface 16, wherein the bottom surface 16 is configured to support the body 12 on a support surface 20. The body 12 is elongated along a central longitudinal axis 66 from a first end 22 to a second end 24, wherein the longitudinal axis 66 is horizontal, and the body 12 is symmetrical about a vertical central plane 68.

The perimeter surface 18 has a pair of lateral portions 26 on each side of the central plane extending from the first end 22 to the second end 24. These lateral portions 26 are contoured such that the body 12 is widest along a first lateral plane proximate the first end 22 and along a second lateral plane proximate the second end 24. The body 12 has a width along the first lateral plane and along the second lateral plane between 11.5 and 12.5 centimeters. The body 12 has a height from the bottom surface 16 to the top surface 14 between 6.5 and 7.5 centimeters and a length from the first end 22 to the second end 24 between 21.7 centimeters and 22.7 centimeters. The body is constructed of a low-density material, wherein the body is configured to abruptly decelerate when moving through a quantity of air due to an air resistance force.

The top surface 14 has a hemispherical divot 28, wherein the divot 28 penetrates into the top surface 14 at a depth equivalent to a radius of the divot 28. A ball 30 is coupled to the divot 28 and has a diameter equivalent to a diameter of a standard golf ball 30 and to a diameter of the divot 28. The ball 30 has a plurality of dimples 32 indenting a spherical surface of the ball 30 which are dispersed across the spherical surface 34, The ball 30 and divot 28 are adjacent the first end 22 to position the ball 30 in an intended golf swing path 71 while minimizing a volume of the body 12 being positioned in the intended golf swing path 71. The ball 30 has a color which contrasts with a color of the body 12. For example, the ball 30 may be white while the body 12 may be green, representative of the color of most standard golf balls 30 and the color of a typical golf course respectively.

The perimeter surface 18 of the body 12 includes an indicia 36 at the first end 22 referencing the position of the divot 28. The term "indicia," as used throughout this detailed description and in the claims, can refer to both singular and a plurality of markings. The markings forming the indicia 36 in the disclosed embodiments may have any of a variety of forms including, for example, a graphical depiction of a golf tee simulated to be protruding from the support surface 20 and a lower portion of a golf ball simulated to be a continuation of the ball 30 from the top surface 14.

In use, the device 10 provides for a method 90 of golf swing training in which a user 38 places the bottom surface 16 of the body 12 on the support surface 20 with the ball 30 being in the intended golf swing path 71, the longitudinal axis 66 being horizontally aligned in an intended direction of travel of the ball 30. Then the user 38 stands with a golf club 40 in alignment with the device 10 such that the user 38 is able to swing the golf club 40 substantially along the intended golf swing path 71. The user 38 swings the golf club 40, striking the ball 30 with the golf club 40, urging the ball 30 in a resultant direction of travel 87. Then the user 38 compares the resultant direction of travel 87 of the ball 30 to the intended horizontal direction of travel of the ball 30. If the resultant direction of travel 87 is substantially aligned with the intended horizontal direction of travel, the user 38 has successfully aimed the golf swing.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A golf swing training device comprising:

a resiliently deformable body having a top surface, a bottom surface, and a perimeter surface extending between said top surface and said bottom surface, said bottom surface being configured to support said body on a support surface, wherein said body is elongated along a central longitudinal axis from a first end to a second end, said longitudinal axis being horizontal, said body being symmetrical about a vertical central plane, wherein said top surface has a divot, said divot having a position adjacent said first end, wherein said body is constructed of a material suitable to abruptly decelerate due to air resistance on said body when said body moves through a quantity of air; and a compactable, resiliently deformable ball mounted to said body in said divot.

2. The device of claim 1, wherein said perimeter surface has a pair of lateral portions on each side of the central plane extending from said first end to said second end, said lateral portions being contoured such that said body is widest along a first lateral plane proximate said first end and along a second lateral plane proximate said second end.

3. The device of claim 2, wherein said body has a width along said first lateral plane and along said second lateral plane between 11.5 and 12.5 centimeters.

4. The device of claim 1, wherein said divot is hemispherical, said divot penetrating into said top surface at a depth equivalent to a radius of the divot.

5. The device of claim 1, wherein said body has a height from said bottom surface to said top surface between 6.5 and 7.5 centimeters.

6. The device of claim 1, wherein said body has a length from said first end to said second end between 21.7 centimeters and 22.7 centimeters.

7. The device of claim 1, wherein said perimeter surface includes an indicia at said first end referencing said position of said divot.

8. The device of claim 1, wherein said ball has a diameter equivalent to a diameter of said divot.

9. The device of claim 1, wherein said ball has a diameter between 4.2 centimeters and 4.3 centimeters.

10. The device of claim 1, wherein said ball has a plurality of dimples indenting a spherical surface of said ball, said dimples being dispersed across said spherical surface.

11. The device of claim 1, wherein said ball has a color which contrasts with a color of said body.

12. The device of claim 1, wherein said body is constructed of an elastic foam.

13. The device of claim 1, wherein said ball is constructed of an elastic foam.

14. The device of claim 1, wherein said body is constructed of a first elastic foam and said ball is constructed of a second elastic foam, an elastic compression strength of said first elastic foam being less than an elastic compression strength of said second elastic foam.

15. A golf swing training device comprising:

a resiliently deformable body having a top surface, a bottom surface, and a perimeter surface extending between said top surface and said bottom surface, said bottom surface being configured to support said body on a support surface, wherein said body is elongated along a central longitudinal axis from a first end to a second end, said longitudinal axis being horizontal, said body being symmetrical about a vertical central plane, said perimeter surface having a pair of lateral portions on each side of the central plane extending from said first end to said second end, wherein said lateral portions are contoured such that said body is widest along a first lateral plane proximate said first end and along a second lateral plane proximate said second end, said body having a width along said first lateral plane and along said second lateral plane between 11.5 and 12.5 centimeters;

wherein said top surface has a hemispherical divot, said divot having a position adjacent said first end, said divot penetrating into said top surface at a depth equivalent to a radius of the divot, wherein said body has a height from said bottom surface to said top surface between 6.5 and 7.5 centimeters, wherein said body has a length from said first end to said second end between 21.7 centimeters and 22.7 centimeters, wherein said perimeter surface includes an indicia at said first end referencing said position of said divot, wherein said body is constructed of a material suitable to abruptly decelerate due to air resistance on said body when said body moves through a quantity of air; and a compactable, resiliently deformable ball mounted to said body in said divot, said ball having a diameter equivalent to a diameter of said divot, wherein said ball has a plurality of dimples indenting a spherical surface of said ball, said dimples being dispersed across said spherical surface, wherein said ball has a color which contrasts with a color of said body.

16. A method of golf swing training comprising:

providing a golf swing training device comprising:

a resiliently deformable body having a top surface, a bottom surface, and a perimeter surface extending between said top surface and said bottom surface, said bottom surface being configured to support said body on a support surface, wherein said body is elongated along a central longitudinal axis from a first end to a second end, said longitudinal axis being horizontal, said body being symmetrical about a vertical central plane, wherein said top surface has a divot, said divot having a position adjacent said first end; and a compactable, resiliently deformable ball mounted to said body in said divot;

placing said bottom surface of said body on said support surface, said ball being in an intended golf swing path, said longitudinal axis being horizontally aligned in an intended direction of travel of said ball;

aligning a user in a standing position with a golf club such that said user is able to swing the golf club substantially along the intended golf swing path;

the user swinging the golf club, the golf club striking said ball, urging said ball in a resultant direction of travel; and comparing visually the resultant direction of travel of said ball to the intended horizontal direction of travel of said ball.

* * * * *